US008613503B2

(12) United States Patent
Kurobe et al.

(10) Patent No.: US 8,613,503 B2
(45) Date of Patent: Dec. 24, 2013

(54) INK TANK HAVING GROOVES TO PREVENT LEAKAGE FROM THE AIR COMMUNICATION HOLE

(75) Inventors: Ryoichiro Kurobe, Kawasaki (JP); Hideo Saikawa, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/545,824

(22) Filed: Jul. 10, 2012

(65) Prior Publication Data

US 2012/0274709 A1 Nov. 1, 2012

Related U.S. Application Data

(62) Division of application No. 12/414,651, filed on Mar. 30, 2009, now Pat. No. 8,246,150.

(30) Foreign Application Priority Data

Apr. 4, 2008 (JP) ..... 2008-098325

(51) Int. Cl.
*B41J 2/175* (2006.01)

(52) U.S. Cl.
CPC ..... *B41J 2/17513* (2013.01)
USPC ..... 347/86

(58) Field of Classification Search
USPC ..... 347/86
See application file for complete search history.

(56) References Cited

U.S. PATENT DOCUMENTS

| | | | | |
|---|---|---|---|---|
| 4,806,032 | A | 2/1989 | Gragg et al. | 400/194 |
| 5,237,342 | A | 8/1993 | Saikawa et al. | 346/140 R |
| 5,444,473 | A | 8/1995 | Hattori et al. | 347/87 |
| 5,500,666 | A | 3/1996 | Hattori et al. | 347/87 |
| 5,619,239 | A | 4/1997 | Kotaki et al. | 347/86 |
| 5,852,457 | A | 12/1998 | Kotaki et al. | 347/86 |
| 6,070,976 | A | 6/2000 | Takagi et al. | 347/86 |
| 6,250,750 | B1 * | 6/2001 | Miyazawa et al. | 347/87 |
| 6,332,676 | B1 * | 12/2001 | Santhanam | 347/86 |
| 7,387,379 | B2 | 6/2008 | Nanjo et al. | 347/86 |
| 2002/0005883 | A1 | 1/2002 | Santhanam | 347/86 |
| 2004/0150698 | A1 | 8/2004 | Caro et al. | 347/86 |
| 2004/0177697 | A1 | 9/2004 | Tokuhara | 73/715 |
| 2006/0132562 | A1 | 6/2006 | Nanjo et al. | 347/86 |

FOREIGN PATENT DOCUMENTS

| | | |
|---|---|---|
| JP | 01-93365 | 4/1989 |
| JP | 2006-150679 | 6/2006 |

* cited by examiner

*Primary Examiner* — Shelby Fidler
(74) *Attorney, Agent, or Firm* — Fitzpatrick, Cella, Harper & Scinto

(57) ABSTRACT

The present invention provides an ink tank in which ink is unlikely to leak from an air communication hole even with variation in the internal pressure of the ink tank or an external impact on the ink tank. Specifically, ink attached to a rib or trapped in a groove may disperse to the vicinity of a projecting portion. In this case, first, a first groove is provided at a predetermined distance from the projecting portion, enabling a reduction in the possibility that the ink disperses from the groove or a remoter area to the projecting portion. Second, even if the dispersing ink enters an area surrounded by the groove, a second groove formed in the area allows the dispersing ink to be trapped therein.

7 Claims, 7 Drawing Sheets

INK TANK HAVING GROOVES TO PREVENT LEAKAGE FROM THE AIR COMMUNICATION HOLE

This application is a divisional of U.S. patent application Ser. No. 12/414,651, filed Mar. 30, 2009 (currently pending), which is incorporated by reference herein in its entirety, as if fully set forth herein, and claims the benefit of priority under 35 U.S.C. §119, based on Japanese Priority Application No. 2008-098325, filed Apr. 4, 2008, which is incorporated by reference herein in its entirety, as if fully set forth herein.

BACKGROUND OF THE INVENTION

1. Field of the Invention

The present invention relates to an ink tank, and specifically to a structure that prevents ink leakage from an ink tank used in an ink jet printing apparatus that ejects ink for printing. The ink tank according to the present invention can be used not only in common printers but also in apparatuses such as copy machines, facsimile machines with communication systems, and word processors with printing sections, as well as industrial printing apparatuses combined with various processing apparatuses.

2. Related Art of the Invention

Ink jet printing apparatuses are based on what is called non-impact printing scheme and have various advantages: the ink jet printing apparatus can achieve high-speed printing, print various print media, and reduce possible noise during printing. Thus, the ink jet printing apparatus is commonly used to make up a printing mechanism for printers, word processors, facsimile machines, copiers, and the like.

In the ink jet printing apparatuses, an ink tank in which ink to be supplied to a print head for ink ejection is stored is in many cases removably used. Specifically, for example, when the stored ink is consumed and exhausted, the ink tank is replaced with another. Thus, the ink tank is of a cartridge type and is often independently distributed and handled as a commercial product.

A conventional ink tank of such cartridge type may present a problem that ink leakage occurs. Various measures against the problem have been provided. In one aspect of the ink leakage, ink may leak through an air communication hole formed, for example, for adjustment of negative pressure in the ink tank. For example, if the posture of the ink tank during physical distribution is such that a surface of the ink tank in which the air communication hole is formed is located below, the ink is likely to leak through the air communication hole depending on the relationship between a change in pressure in the tank and the atmospheric pressure at the time. Furthermore, if the ink tank is subjected to a relatively great impact during handling, a similar pressure change occurs to make the ink likely to leak.

Japanese Patent Laid-Open No. Hei 1-93365 (1989) describes a structure that prevents the ink leakage. Japanese Patent Laid-Open No. Hei 1-93365 (1989) describes an ink tank housing an absorber to hold the ink, being provided with a truncated cone-like projecting portion located on a back surface of a cover member making up a tank case and away from the absorber, and having a hole passing through the projecting portion to be an air communication hole. A groove is formed along a root portion of the projecting portion so that the ink leaking from the absorbing member is trapped by the capillary force of the groove, to limit a movement of the ink to the through-hole in the projecting portion.

Japanese Patent Laid-Open No. 2006-150679 describes another structure that prevents the ink leakage. Japanese Patent Laid-Open No. 2006-150679 describes an ink tank including no projecting portion projecting into the tank as in Japanese Patent Laid-Open No. Hei 1-93365 but a hole formed directly in the cover member of the ink tank and serving as an air communication hole. A groove is formed at a given distance from the air communication hole so as to surround the communication hole so that the ink is trapped by the capillary force of the groove. Japanese Patent Laid-Open No. 2006-150679 also describes that the groove is extended to a position where the groove contacts the absorber so that the trapped ink is finally returned to the absorber.

However, when, for example, the ink tank in Japanese Patent Laid-Open No. Hei 1-93365 (1989) is subjected to relatively intense vibration, the ink trapped in the groove around the projecting portion may fly off and enter the air communication hole.

FIGS. 1A to 1C are views illustrating this problem. The figures show vertical sectional views of the ink tank. Specifically, FIG. 1A shows a part of the ink tank in which a print element board 1500 making up a print head is integrally attached to a tank case 1400. An absorber 1700 is housed in the tank case 1400. The ink held by the absorber 1700 is supplied to the print element board 1500 via an ink channel 1401 as an ejection operation or the like is performed. In FIG. 1A, a cover member 1800 makes up the tank case below the absorber 1700. The cover member 1800 includes a truncated conical projecting portion 1817 and a rib 1809. The rib 1809 contacts the absorber 1700 to form a space 1402 between the truncated conical projecting portion 1817 and the absorber 1700. As described in Japanese Patent Laid-Open No. Hei 1-93365, a groove 1813 is formed along the root portion of the truncated conical projecting portion 1817, forming an air communication hole 1801, that is, the groove 1813 is formed at a position not away from the projecting portion 1817.

However, in the case that the groove 1813 is not formed away from the truncated conical projecting portion 1817, the ink trapped in the groove 1813 may fly off and enter the air communication hole 1801. For example, variation in environmental temperature or the like may change the pressure in the ink tank to cause the ink to leak and flow from the absorber 1700 toward the cover member 1800. As shown in FIG. 1B, the flowing ink is trapped in the groove 1813 and can thus be prevented from reaching the air communication hole. However, if a relatively great impact is made on the ink tank, for example, the tank falls down, the ink trapped in the groove 1813 may disperse as shown in FIG. 1C. The ink 1819 may then enter the air communication hole 1801. Upon entering the air communication hole, the ink leaks from an air communication passage outlet through an air communication path formed in a surface of the cover member.

On the other hand, according to Japanese Patent Laid-Open No. 2006-150679, the air communication hole is not formed in the projecting portion. Consequently, the leaking ink basically travels through the member forming the air communication hole and readily enters the air communication hole. Thus, in Japanese Patent Laid-Open No. 2006-150679, the groove is formed at the given distance from the air communication hole to trap the ink.

However, the ink entering the area surrounded by the groove can no longer be trapped and is likely to enter the air communication hole.

SUMMARY OF THE INVENTION

An object of the present invention is to provide an ink tank in which ink is unlikely to leak from an air communication hole even with variation in the internal pressure of the ink tank or an external impact on the ink tank.

In a first aspect of the present invention, there is provided an ink tank for storing ink, comprising: a case member forming a chamber for storing ink; a projecting portion that is provided on a part of the case member and projects toward an interior of the ink tank, an air communication hole being formed in the projecting portion so as to pass through the projecting portion; a first groove formed on the case member so as to surround the projecting portion, the first groove being away from the projecting portion; and a second groove formed on an area in the case member which the first groove surrounds, the second groove branching from the first groove and being away from the projecting portion.

In a second aspect of the present invention, there is provided an ink tank for storing ink, comprising: a case member forming a chamber for storing ink; an absorber for holding ink, the absorber being housed inside the chamber formed by the case member, a projecting portion that is provided on a part of the case member and projects toward a space between the absorber and the case member, an air communication hole being formed in the projecting portion so as to pass through the projecting portion; a first groove formed on the case member so as to surround the projecting portion, the first groove being away from the projecting portion; and a second groove formed on an area in the case member which the first groove surrounds, the second groove branching from the first groove and being away from the projecting portion.

In the above-described structure, the ink leaking in the ink tank may travel to the case member and then disperse to the vicinity of the projecting portion forming the air communication hole because of impact or the like. In this case, first, the first groove is located at the predetermined distance from the projecting portion, enabling a reduction in the possibility that the ink flies from the first groove or a remoter area than the first groove to the projecting portion. Second, even if the flying ink enters the area surrounded by the first groove, the second groove formed inside the surrounded area allows the flying ink to be trapped therein.

As a result, an ink tank can be provided which allows the ink to be prevented from leaking from the air communication hole even with variation in the internal pressure of the ink tank or an external impact on the ink tank.

Further features of the present invention will become apparent from the following description of exemplary embodiments (with reference to the attached drawings).

DESCRIPTION OF THE EMBODIMENTS

Embodiments of the present invention will be described below with reference to the drawings.

Figure 2:
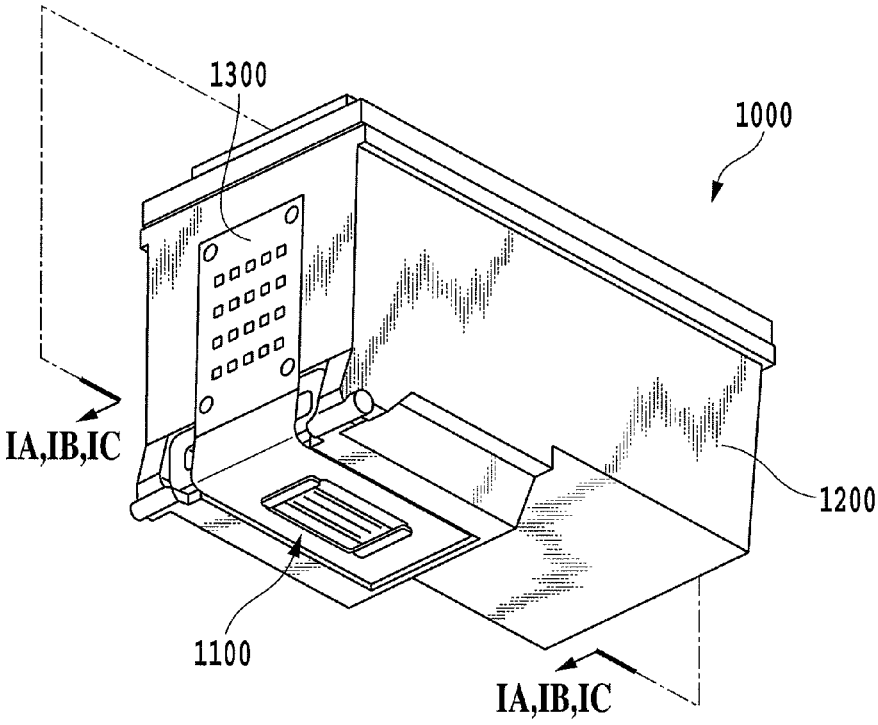
FIG. 2 is a perspective view of an ink jet cartridge in which the ink tank according to an embodiment of the present invention is integrated with a print head, as viewed from the print head side.

FIG. 2 is a perspective view showing the appearance of an ink tank according to an embodiment of the present invention. The ink tank is of a cartridge type in which the ink tank is formed integrally with a print head (the ink tank is hereinafter referred to as an "ink jet cartridge"). As shown in FIG. 2, an ink jet cartridge 1000 according to the present embodiment is composed of a print head portion 1100 and an ink tank portion 1200. The print head portion 1100 includes a print element board which allows electrothermal conversion elements with heating resistors to heat ink so that the resulting film boiling allows ink droplets to be ejected, and an electric wiring board 1300 that feeds a driving signal and the like from the a printer main body to the print element board.

Figure 3:
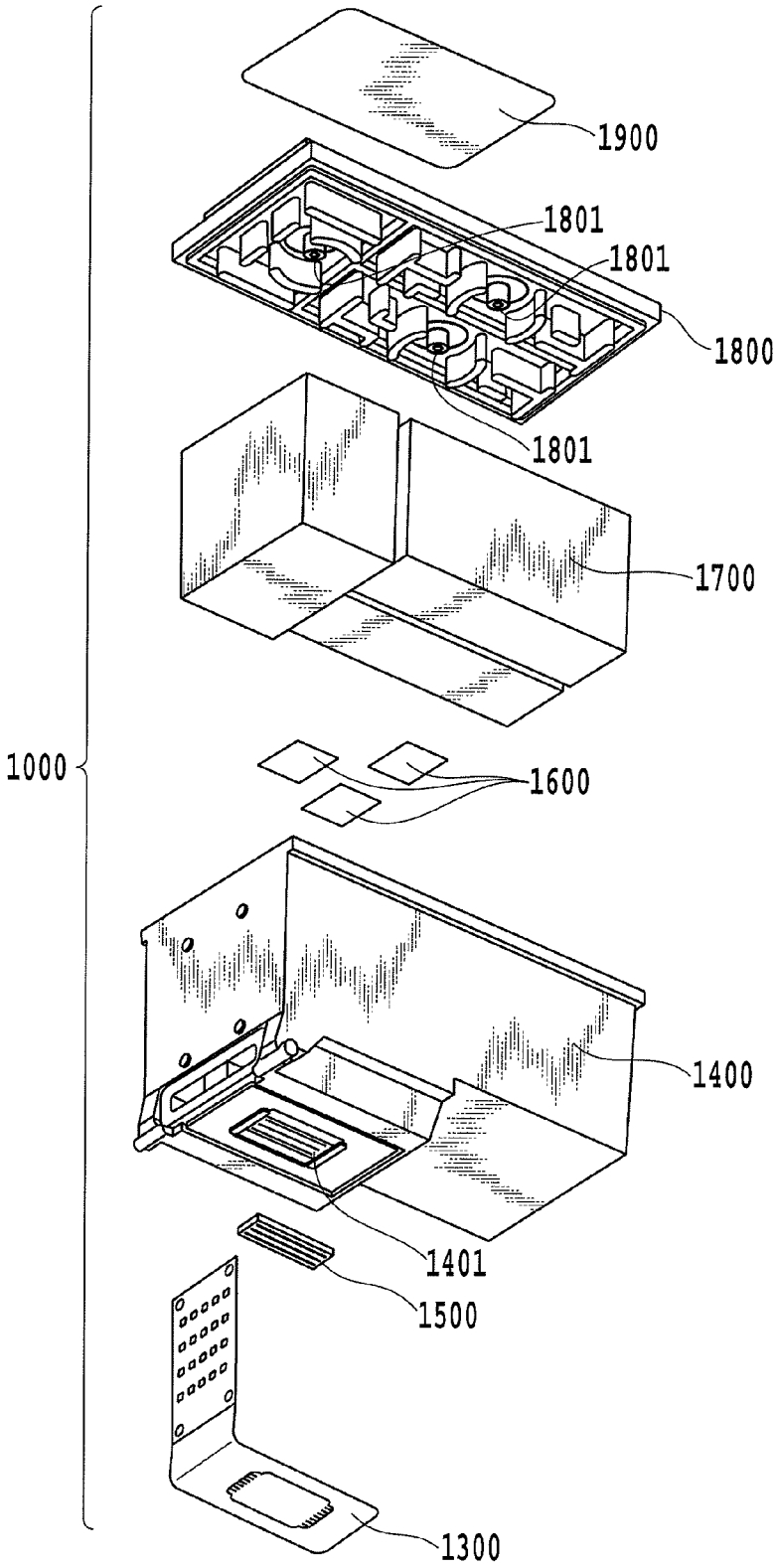
FIG. 3 is an exploded perspective view of the ink jet cartridge shown in FIG. 2.
Figure 4:
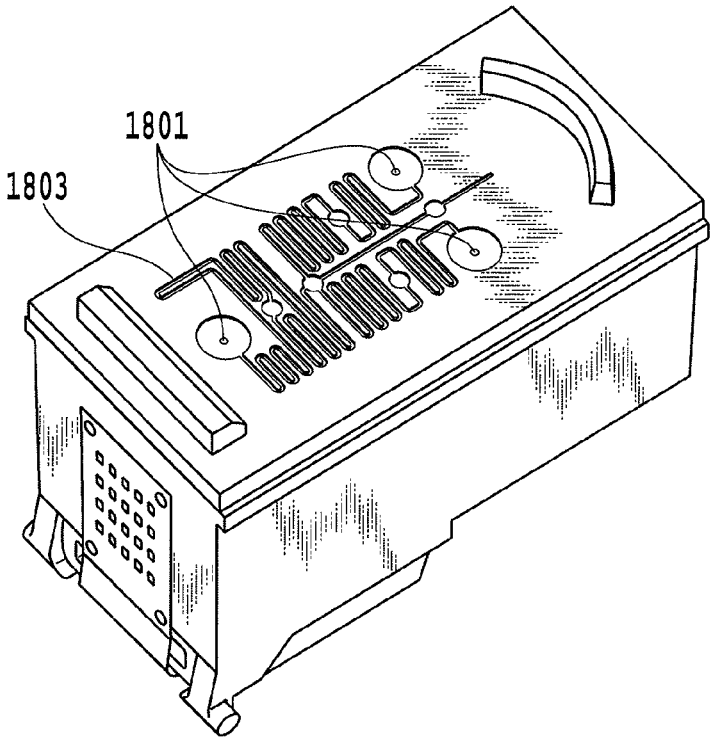
FIG. 4 is a view illustrating the air communication hole in the ink tank in the ink jet cartridge shown in FIG. 2.

FIG. 3 is an exploded perspective view of the ink jet cartridge 1000. A tank case 1400 has a recessed portion on a bottom surface thereof so as to receive the print element board in the recessed portion. An ink channel 1401 is formed in the center of the recessed portion. The print element board 1500 is electrically connected to the electric wiring board 1300 and joined to the tank case 1400. The tank case 1400 includes an absorber 1700 holding ink therein and a filter 1600 located between the absorber and the ink channel. A top opening plane of the tank case 1400 is closed by a cover member 1800, which includes an air communication hole 1801 through which the space inside the tank communicates with outside air. A groove described below with reference to FIG. 4 is formed in a top surface of the cover member 1800. A sheet member 1900 is joined to the top surface of the cover member 1800.

Figure 1A:
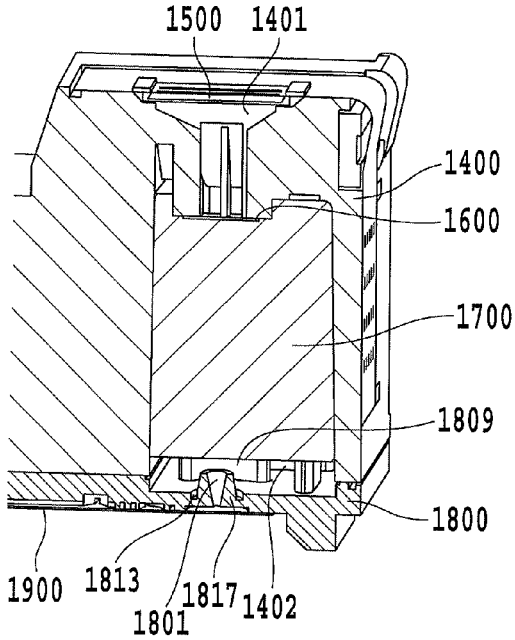
FIG. 1A is a view showing a vertical cross section of a conventional ink tank.
Figure 1B:
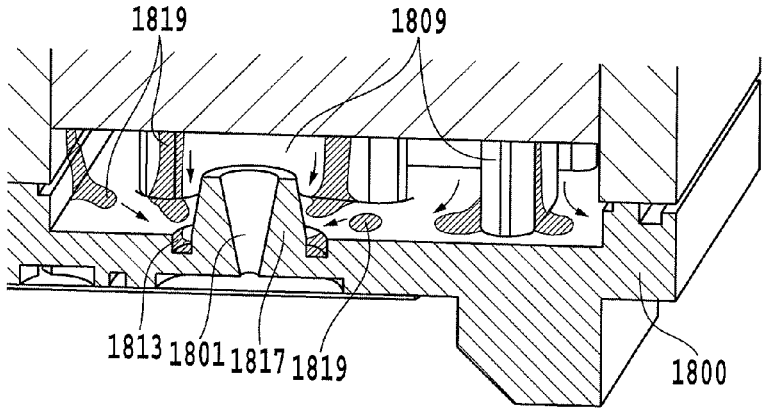
FIGS. 1B and 1C are views showing how ink is trapped in a groove in the ink tank structure shown in FIG. 1A and how the ink enters an air communication hole, respectively.
Figure 1C:
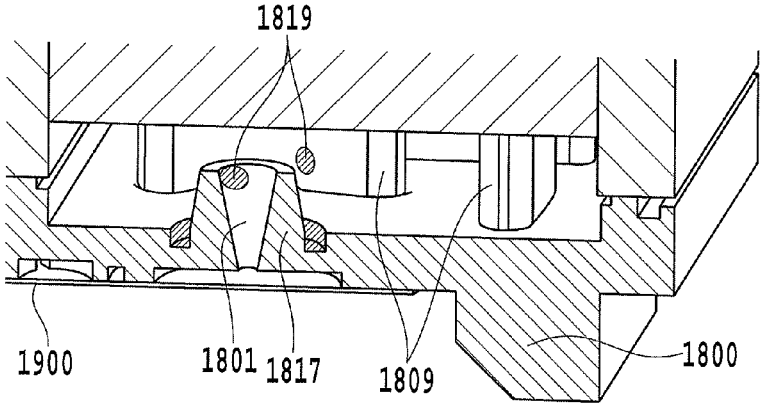

The conventional structure shown in FIG. 1A is the same as the ink jet cartridge according to the present embodiment except for a structure for a groove formed around the truncated conical projecting portion 1817 on the cover member 1800 of the ink tank according to the embodiment of the present invention. FIG. 1A corresponds to a figure showing a part of a cross section IA-IA shown in FIG. 2. In FIG. 1A, the absorber 1700 holds ink by means of the capillary force thereof and allows the ink to be fed to the print element board 1500 via the ink channel 1401. The absorber 1700 is pressed by ribs 1809 on the cover member. Furthermore, a space 1402 is formed in the ink tank portion. The space 1402 in the tank communicates with a surface of the cover member 1800 which corresponds to the exterior of the tank, via the air communication hole 1801, which is formed in the projecting portion 1817 of the cover member.

FIG. 4 is a perspective view of the ink jet cartridge 1000 as viewed from a top surface thereof; the sheet member 1900 is omitted from the ink jet cartridge 1000 for description of an air communication passage. As shown in FIG. 4, the air communication holes 1801, which open on the surface of the cover member 1800, are connected to a labyrinth-like air communication passage 1803 formed on the surface of the cover member 1800. The sheet member 1900 is joined on the air communication passage so as to form an air communication passage outlet.

Description will be given of several embodiments relating to the groove around the air communication hole based on the structure of the ink tank according to the present embodiment, described above.

(Embodiment 1)

Figure 5A:
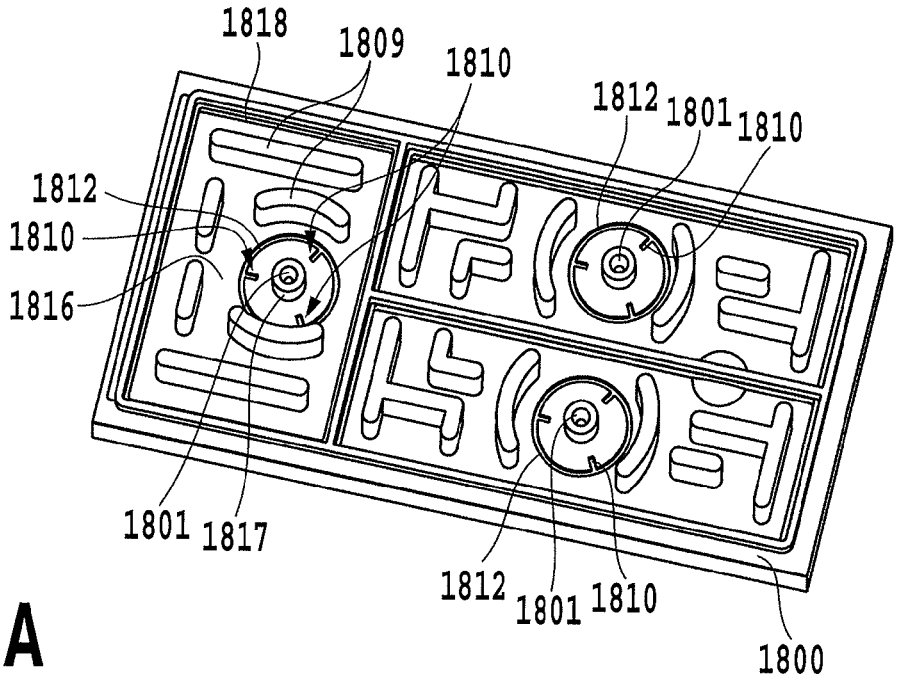
FIGS. 5A and 5B are views of a cover member used for an ink tank of an ink jet cartridge according to a first embodiment of the present invention, as viewed from the inside of the ink tank.
Figure 5B:
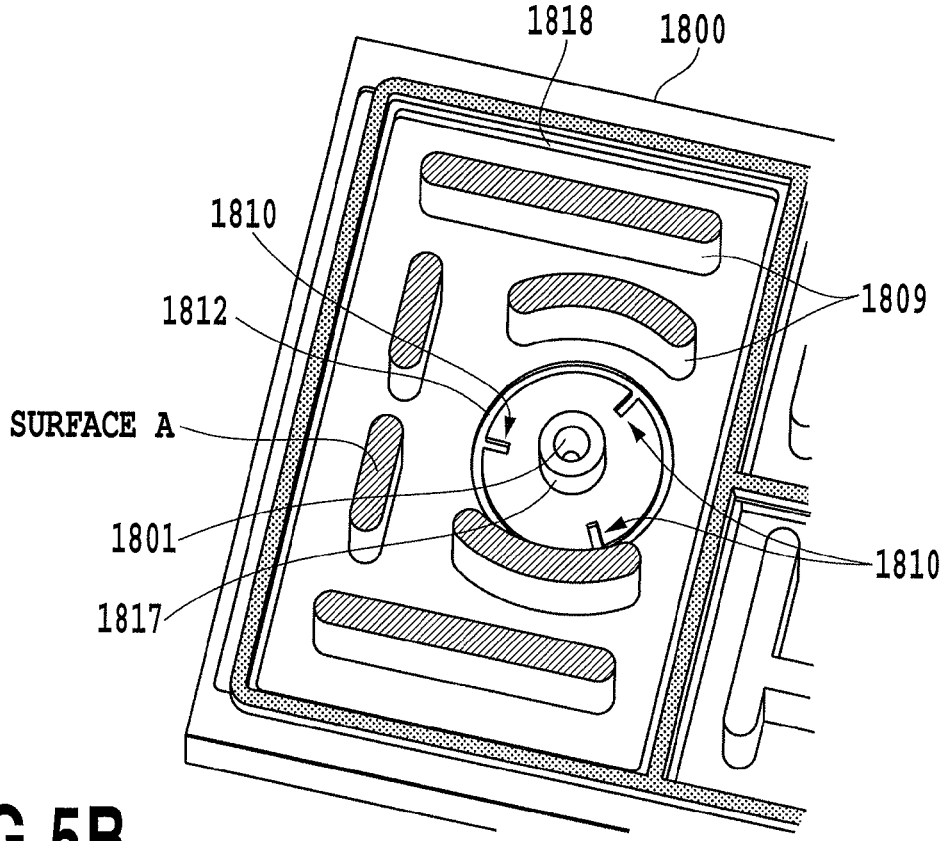

FIG. 5A is a view showing a surface of the cover member 1800 of the ink tank according to a first embodiment of the present invention which surface corresponds to the interior of the ink tank. FIG. 5B is a partly enlarged view of the cover member. The ink tank according to the present embodiment includes three ink tanks for respective colors integrated together. The cover member correspondingly includes three components for the respective ink chambers integrated together. However, of course, the application of the present invention is not limited to this aspect. For example, the present structure is applicable to a single-color cartridge.

As shown in FIGS. 5A and 5B, the cover member 1800 includes a truncated conical projecting portion 1817 with the air communication hole 1801 formed therein, and the ribs 1809 that press the absorber at a surface A (shaded surface in FIGS. 5A and 5B); the projecting portion 1817 and the ribs 1809 are provided for each of the three ink chambers. Moreover, the cover member 1800 includes a first groove 1812 formed away from the truncated conical projecting portion 1817 so as to surround the projecting portion 1817, and three second grooves 1810 branching from the first groove and extending to a position between the first groove and the center of the air communication hole.

Figure 6A:
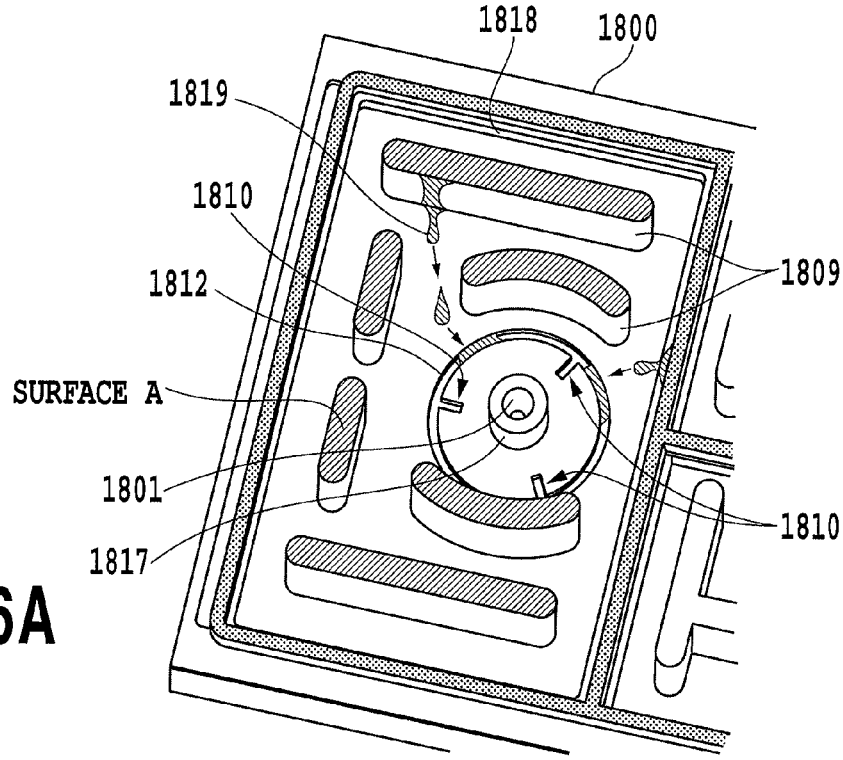
FIG. 6A is a view illustrating how, in the ink tank shown in FIG. 5, ink having left an absorber travels along an ink chamber outer peripheral wall of the cover member and a rib pressing the absorber, to reach the bottom surface of the cover member, and is trapped in the groove.

As described above, when variation in pressure or the like causes the ink held in the absorber to start leaking, the ink may travel along an outer peripheral wall 1818 and the rib 1809 of the cover member to a bottom surface 1816 as shown in FIG. 6A. In this condition, in the present structure, the ink having reached the bottom surface is trapped in the first groove 1812 as shown in FIG. 6A.

Figure 6B:
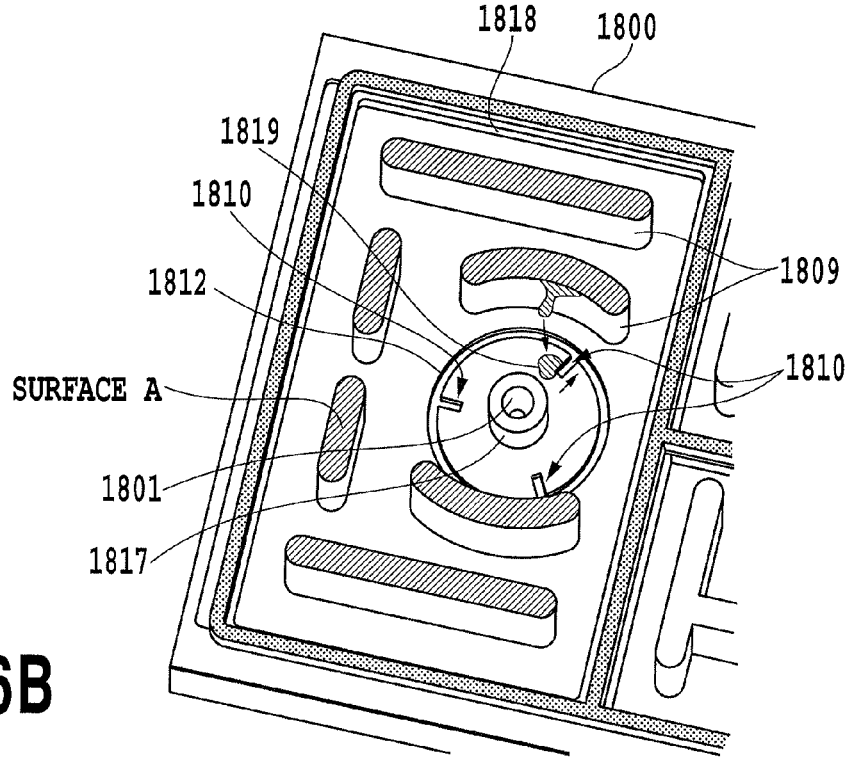
FIG. 6B is a view showing how the ink attached to the rib pressing the absorber disperses to the vicinity of the air communication hole and is then trapped in the groove.

Moreover, as shown in FIG. 6B, an impact or the like may cause the ink attached to the rib 1809 or trapped in the groove 1812 to fly to the vicinity of the projecting portion 1817. In this case, first, since the groove 1812 is formed at the predetermined distance from the projecting portion 1817, the possibility that the ink flies from the groove 1812 or a remoter area than the groove to the projecting portion 1817 can be reduced. Second, even if the dispersing ink enters the area surrounded by the groove 1812, the second groove 1810, formed in the surrounded area, allows the dispersing ink to be trapped therein.

As is apparent from the above description, since the ink is trapped in the first and second grooves, the first and second grooves are desirably formed away from the projecting portion 1817 so as to locate the ink as far from the air communication hole as possible.

Moreover, the second groove 1810 is formed at a plurality of areas, and the angles between any adjacent two of these grooves are set to be same as each other in a well-balanced manner. Thus, even if the ink flies to the vicinity of the projecting portion, the ink is easily trapped. Specifically, in the area surrounded by the groove 1812, the plurality of grooves 1810 are evenly distributed to increase the possibility of catching the ink.

Furthermore, in view of a capillary force required to trap the ink, the width and depth of the groove are desirably both set to 0.4 mm. Moreover, for the width, the first groove 1812 is narrower than the second groove 1810. This allows the ink trapped in the groove 1810 to be easy held in the first groove 1812, which exerts a stronger capillary force. This structure is more advantageous in prevention of possible leakage of the ink to the air communication hole.

Regardless of the posture taken during distribution, the ink tank configured as described above the ink to be prevented from leaking from the air communication hole even with variation in the internal pressure of the ink tank or an external impact on the ink tank.

(Embodiment 2)

Figure 7A:
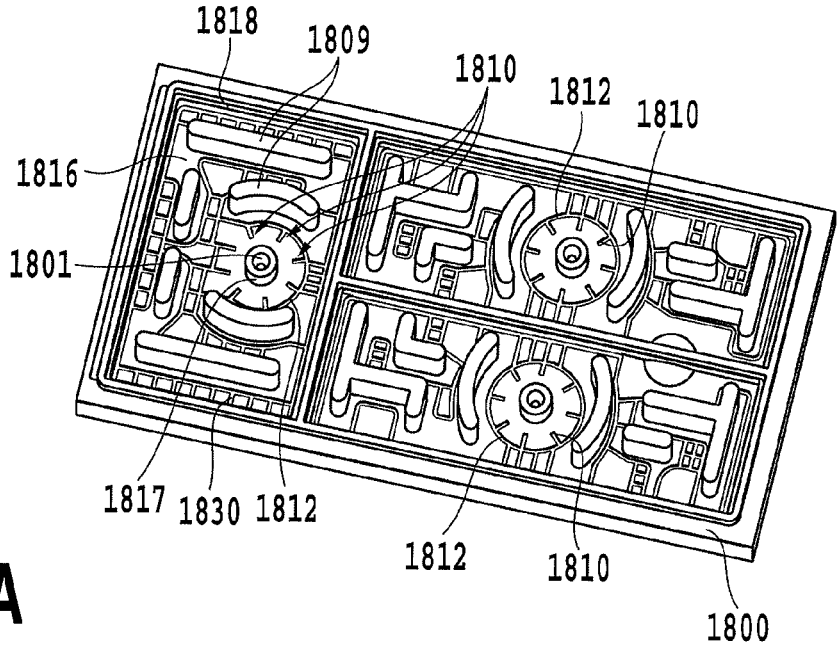
FIGS. 7A and 7B are views of a cover member used for an ink tank of an ink jet cartridge according to a second embodiment of the present invention, as viewed from the inside of the ink tank.
Figure 7B:
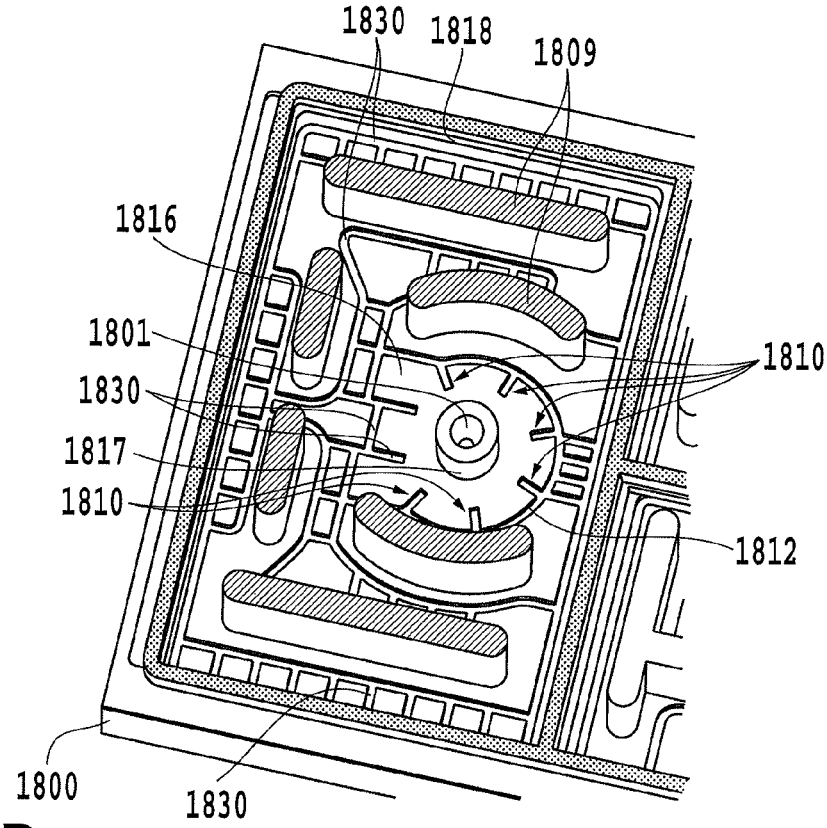

FIG. 7A is a perspective view showing a structure of a cover member of an ink tank according to a second embodiment of the present invention. FIG. 7B is a partly enlarged view of FIG. 7A.

As shown in these figures, in the present embodiment, the first groove 1812 is formed around the air communication hole as in the case of the first embodiment. Furthermore, a third groove 1830 is formed in an outer peripheral portion of the bottom surface 1816, which lies opposite the absorber housed in the ink storage chamber, and around each of the ribs 1809. That is, the third groove 1830 is formed outside the area surrounded by the first groove. Additionally, eight second grooves 1810 are formed which branch from the first groove and extend to a position between the first groove and the air communication hole.

When the ink held in the absorber leaks and flows toward the cover member owing to the posture of the ink tank or variation in pressure, the ink travels along the outer peripheral wall 1818 and the rib 1809 to the bottom surface 1816. Thus, in the present embodiment, the third groove 1830 is formed in the outer peripheral portion of the bottom surface 1816 and around each of the ribs 1809. This allows the ink to be caught at a position further from the air communication hole, enabling a reduction in the possibility that the ink disperses and reaches the air communication hole because of impact or the like. Furthermore, the number of the second grooves 1810 is larger than that in the first embodiment, and the second grooves 1810 are arranged at the evenly distributed positions. Thus, even if the ink flies to the vicinity of the projecting portion 1817 of the air communication hole, the dispersing ink can be reliably trapped.

As is apparent from the above description, also in the present embodiment, the ink is trapped in the first and second grooves. Thus, the first and second grooves are desirably formed away from the projecting portion 1817 so as to locate the ink as far from the air communication hole as possible.

In the present embodiment, the third groove 1830 is one continuous groove for each ink chamber. However, the third groove may be separated into a piece corresponding only to the rib abutting against and pressing the absorber and a piece corresponding only to the outer peripheral wall.

(Other Embodiments)

In the ink jet cartridge in the above-described embodiments, the ink tank and the print head are integrated together by way of example. Of course, the application of the present invention is not limited to this aspect. As is apparent from the above description, the present invention is applicable to the structure of the air communication hole in the stand-alone ink tank provided separately from the print head.

In the above-described embodiments, the ink absorber is housed in the ink tank. However, the application of the present invention is not limited to this aspect. For example, the groove arrangement in the above-described embodiment is applicable to an ink tank including an ink bag in which ink is stored and which is housed in a housing of the tank so that negative pressure is adjusted by the ink bag and a spring member via the air communication hole formed in the housing. That is, even if unexpected ink leakage occurs via a connection portion of the ink bag, the above-described groove arrangement allows the leaking ink to be prevented from leaking to the exterior of the tank via the air communication hole.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-98325, filed Apr. 4, 2008, which is hereby incorporated by reference herein in its entirety.

What is claimed is:

1. An ink tank for storing ink, comprising:

a case member and a cover member which form a chamber for storing ink;

an absorber for holding ink, the absorber being provided inside the chamber;

a projecting portion provided on an inner surface of the cover member and projecting toward the absorber;

an air communication hole formed in the projecting portion so as to pass air through the projecting portion;

a plurality of ribs contacting the absorber, the plurality of ribs being provided on the inner surface of the cover member;

a first groove formed on the inner surface of the cover member so as to surround the projecting portion, the first groove being spaced apart from the projecting portion; and a second groove formed on the inner surface of the cover member and formed around an outside of an area surrounded by the first groove;

wherein the second groove is formed along a peripheral portion of the cover member so as to define a closed area inside of the second groove, the plurality of ribs are provided inside of the closed area, and the first groove and the second groove are communicated with each other.

2. An ink tank as claimed in claim 1, further comprising a third groove formed on the inner surface of the cover member and formed along the ribs.

3. An ink tank as claimed in claim 1, further comprising a plurality of third grooves formed on the inner surface of the cover member and extending in a direction crossing to the peripheral portion, the plurality of third grooves branching from the second groove.

4. An ink tank as claimed in claim 1, wherein a rib of the plurality of ribs in the vicinity of the projecting portion has a curved surface curving along the projecting portion.

5. An ink tank as claimed in claim 4, wherein a rib of the plurality of ribs in the vicinity of the peripheral portion has a plane surface extending along the peripheral portion.

6. An ink tank as claimed in claim 1, wherein the ink tank has three chambers and each of the three chambers stores ink of different colors.

7. An ink jet cartridge integrally including an ink tank as claimed in claim 1 and a print head for ejecting ink supplied from the ink tank.

* * * * *